US006699077B1

(12) United States Patent
Liu

(10) Patent No.: US 6,699,077 B1
(45) Date of Patent: Mar. 2, 2004

(54) INPUT MODULE

(75) Inventor: Lu-Ta Liu, Taipei (TW)

(73) Assignee: Lankom Electronics Co., Ltd., Taipei (TW)

( * ) Notice: Subject to any disclaimer, the term of this patent is extended or adjusted under 35 U.S.C. 154(b) by 0 days.

(21) Appl. No.: 10/414,293

(22) Filed: Apr. 16, 2003

(51) Int. Cl.[7] ..... H01R 24/00
(52) U.S. Cl. ..... 439/676; 439/941
(58) Field of Search ..... 439/676, 941, 439/540.1, 541.5

(56) References Cited

U.S. PATENT DOCUMENTS 5,531,612 A * 7/1996 Goodall et al. ..... 439/541.5
5,639,267 A * 6/1997 Loudermilk ..... 439/701
6,080,011 A * 6/2000 Tsao et al.
6,267,628 B1 * 7/2001 Meckley et al. ..... 439/676
6,413,120 B1 * 7/2002 Winings et al. ..... 439/676
6,419,526 B1 * 7/2002 Fair et al. ..... 439/676
6,461,200 B1 * 10/2002 Shi et al. ..... 439/676
6,540,564 B1 * 4/2003 Ko ..... 439/676
6,579,121 B2 * 6/2003 Belopolsky ..... 439/541.5
6,585,540 B2 * 7/2003 Gutierrez III et al. ..... 439/620

* cited by examiner

*Primary Examiner*—Gary Paumen
*Assistant Examiner*—Briggitte R. Hammond
(74) *Attorney, Agent, or Firm*—Varndell & Varndell, PLC

(57) ABSTRACT

An input module has two resilient leg sets, two L-shaped seats oppositely and detachably connected to one another. Each seat has through holes defined through a horizontal section of the seat and a grill defined in a vertical section of the seat to correspond to the through holes such that first ends of resilient legs of a corresponding one of the two resilient leg sets securely extend out from the through holes and second ends movably received in the grill.

8 Claims, 3 Drawing Sheets

INPUT MODULE

BACKGROUND OF THE INVENTION

1. Field of the Invention

The present invention relates to an input module, and more particularly to the input module having two separate seats each provided with a resilient leg set. The two seats are opposite to each other and combined with each other to form a module. With the modularized input module, the assembly speed is increased and test for defects can be performed during the assembly.

2. Description of Related Art

Connectors such as RJ45, RJ11, Rj12 are often used in the computers for connection with the INTERNET. Although these connectors function to transfer signals, certain factors such as cross-talk and other interference may have to be taken into consideration to avoid damage to the quality of signal. In most cases, the common method to avoid interference and cross-talk is to add in passive elements such as a resistor or inductor to the transfer of the connector. However, the addition of the passive elements adds complexity to the structure of the connector. Besides, tests for defects of the connector can not be performed until the entire assembly process of the connector is finished. Therefore, there is no way for the operator to find out and amend connection defects of the connector during assembly, which is quite a waste.

To overcome the shortcomings, the present invention tends to provide an improved modulated connector to mitigate and obviate the aforementioned problems.

SUMMARY OF THE INVENTION

The primary objective of the present invention is to provide an improved modulated input module having two identical seats each being opposite to and combined with one another to form a module such that the assembly speed is able to be increased.

Another objective of the present invention is to provide an improved modulated input module enabling the operator to perform connection tests during the assembly of the input module so that defective modules can be eliminated before the completion of the connector.

Other objects, advantages and novel features of the invention will become more apparent from the following detailed description when taken in conjunction with the accompanying drawings.

DETAILED DESCRIPTION OF THE PREFERRED EMBODIMENT

Figure 1:
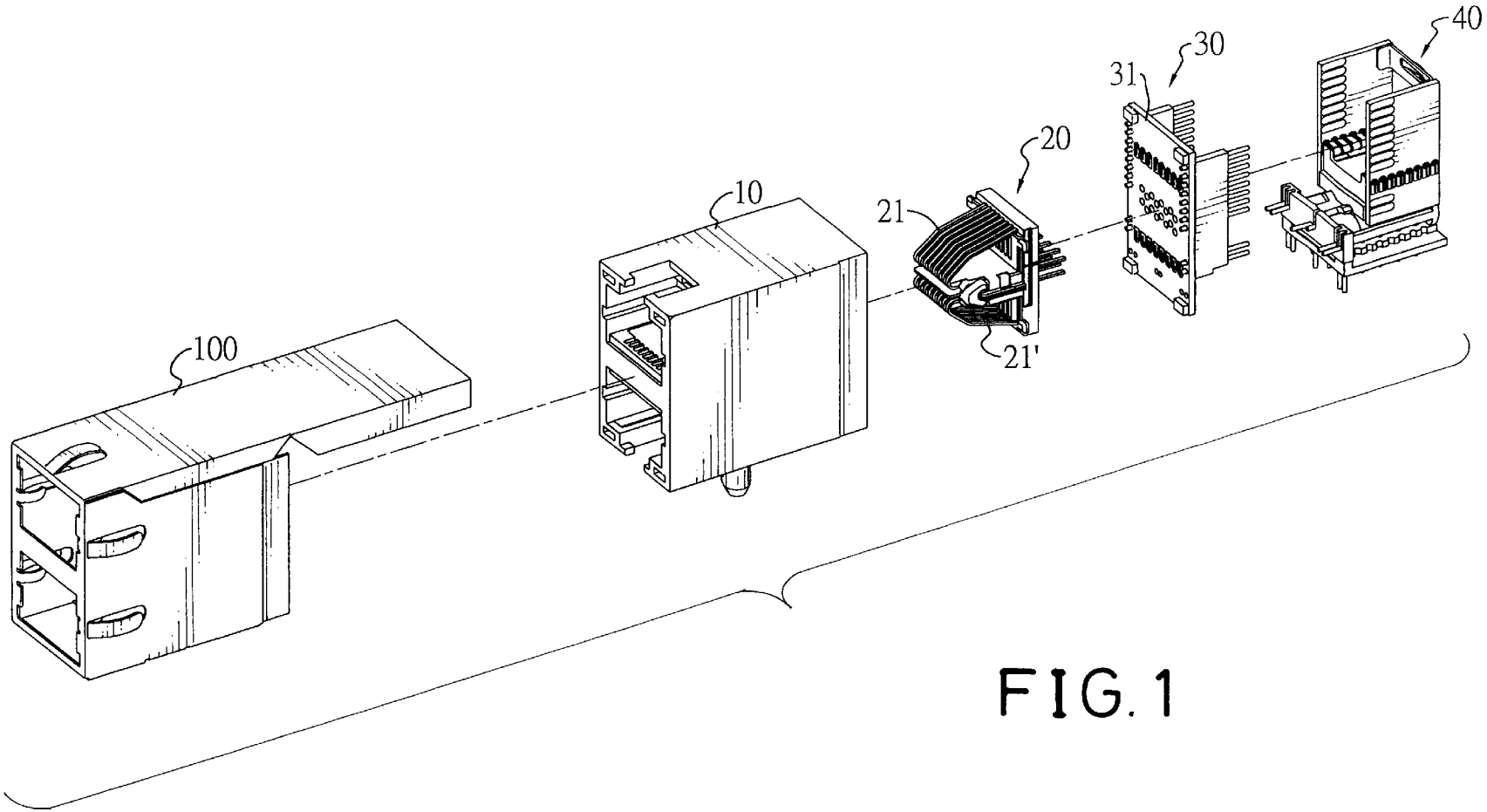
FIG. 1 is an exploded perspective view of a modulated connector with an input module of the present invention received therein.

With reference to FIG. 1, the modulated input module (20) in accordance with the present invention is used with a cover (10), a metal housing (100), a transfer module (30) and an applied terminal module (40).

The input module (20) includes two resilient leg sets (21,21') symmetrically abutted to one another. The transfer module (30) is electrically connected to the two resilient leg sets (21,21') of the input module via a circuit board (31). The applied terminal module (40) is securely connected to the transfer module to adapt to connect to other electrical elements.

Figure 2:
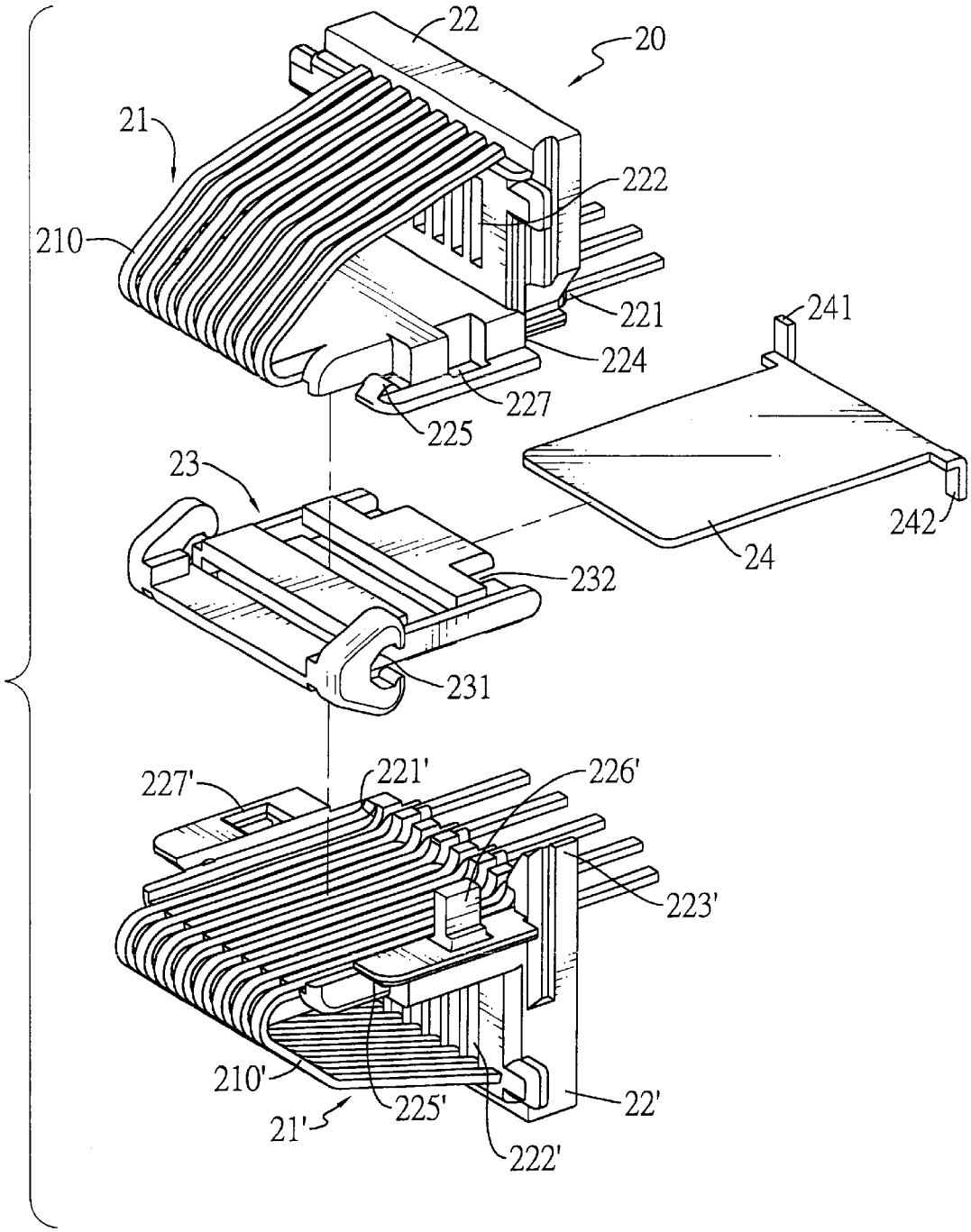
FIG. 2 is an exploded perspective view of the input module of the present invention.

With reference to FIG. 2, the input module (20) further has two identical L-shaped seats (22,22') oppositely abutted to each other and each has through a set of holes (221,221') defined through the horizontal section of the respective seats (22,22'), a grill (222,222') defined in the vertical section of the respective seats (22,22') to correspond to the through holes (221,221'), resilient legs (210,210') each having a first end securely extending out from a corresponding one of the through holes (221,221') and a second end movably received in a corresponding one of the grills (222,222'), a hook (223) extending from a joint of the vertical section and the horizontal section of the respective seats (22,22'), a notch (224) defined in the respective seat (22,22') opposite to the hook (223), two securing ears (225,225') respectively formed on two opposite sides of the respective seats (22,22'), an isolation plate (23) and a grounding plate (24).

The isolation plate (23) has two clamping rings (231) respectively formed on opposite sides of the isolation plate (23) to correspond to the securing ears (225,225') and a hole (232) defined through the isolation plate (23).

The grounding plate (24) has a first extension plate (241) and a second extension plate (242) extending out from the grounding plate (24) in a direction opposite to that of the first extension plate (241).

When the input module (20) is in assembly, the two seats (22,22') are oppositely abutted to one another with the isolation plate (23) sandwiched between the two resilient leg sets (21,21') and the grounding plate (24) inserted into the hole (232) of the isolation plate (24). Then the hook (223) of each of the seats (22,22') clamps a corresponding one of the notches (224) to secure engagement of one side of the two seats (22,22'). Thereafter, the two securing ears (225,225') are combined and inserted into a corresponding one of the two clamping rings (231) of the isolation plate (23). After the securing ears (225,225') are received in the corresponding clamping rings (231), the first and second extension plates (241,242) abut a side face of the vertical section of the respective seats (22,22').

Figure 3:
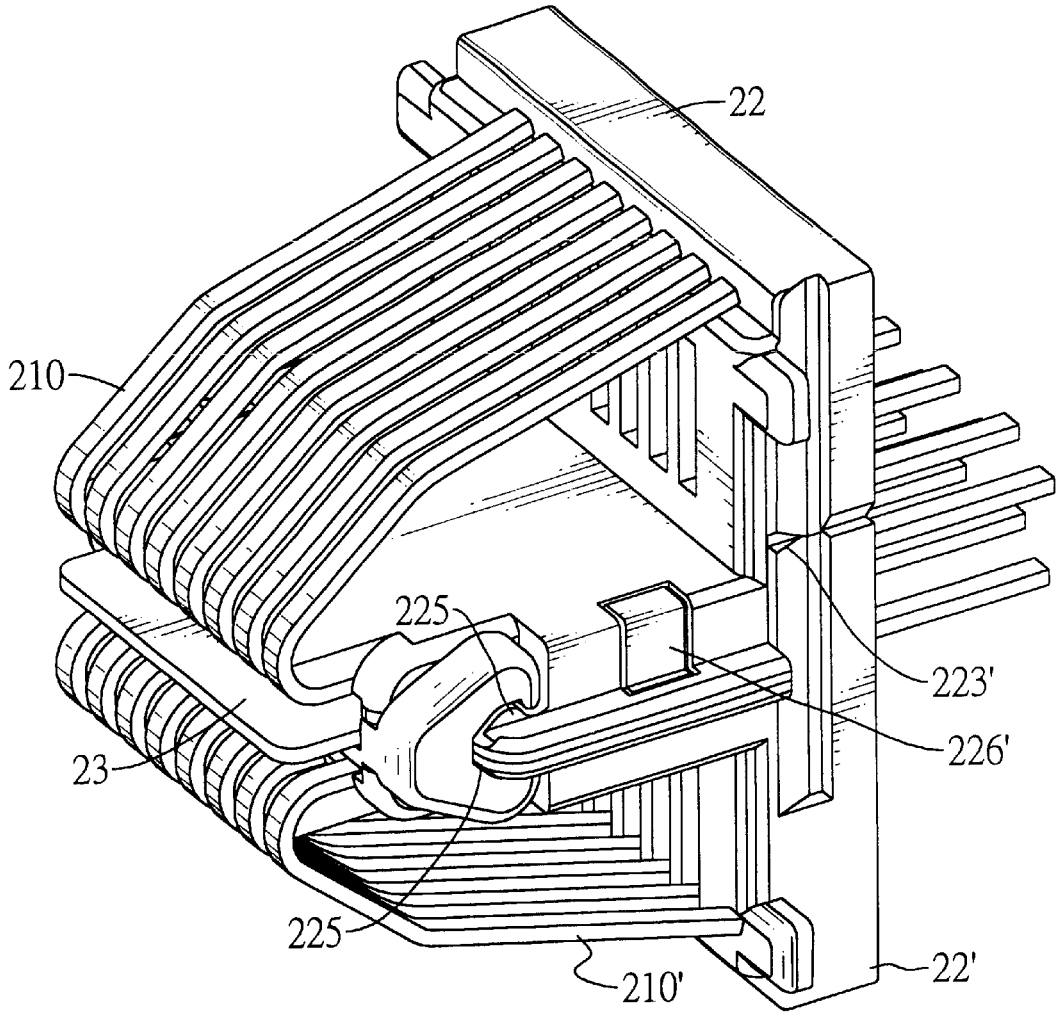
FIG. 3 is a perspective view of the input module in assembly.

With reference to FIG. 3, when the input module (20) is assembled, the two ears (225,225') are inserted into the clamping rings (231) of the isolation plate (23) and the hooks (223,223') are, inserted into the corresponding notches (224,224'). However, to increase the stability of the input module, each of the seats (22,22') has a positioning rod (226,226') and a positioning hole (227,227') oppositely defined in one side of the seat (22,22') so that when the two seats (22,22') are combined with each other, the extension of the positioning rods (226,226') into the corresponding positioning holes (227,227') secures the engagement between the two seats (22,22').

Because each element of the connector is modularized, assembly of the input module is to connect one modularized element to another so that the assembly speed is increased. Furthermore, before assembling the metal housing (100) and the cover (10), the modulated elements are electrically connected to each other. Therefore, the operator is able to perform connection tests in order to remove the defective elements from the modulated elements whereby acceptable quality elements are saved, which saves cost and is efficient.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An input module comprising:

two resilient leg sets;

two L-shaped seats oppositely and detachably connected to one another, each seat having through holes defined through a horizontal section of the seat, a grill defined in a vertical section of the seat to correspond to the through holes such that first ends of resilient legs of a corresponding one of the two resilient leg sets securely extend out from the through holes and second ends movably received in the grill.

2. The input module as claimed in claim 1, wherein each L-shaped seat has a positioning rod and a positioning hole oppositely defined in one side of the seat so that extension of the positioning rods into corresponding positioning holes secures engagement between the two L-shaped seats.

3. The input module as claimed in claim 1, wherein the L-shaped seat has a hook extending from a joint of the vertical section and the horizontal section of the L-shaped seat, a notch opposite to the hook and securing ear formed on two opposite sides of each of the L-shaped seat, such that the hook from one L-shaped seat is able to be received in the notch of the other L-shaped seat and the securing ear from each of the L-shaped seats are able to be combined together.

4. The input module as claimed in claim 3, wherein each L-shaped seat has a positioning rod and a positioning hole oppositely defined in one side of the seat so that extension of the positioning rods into corresponding positioning holes secures engagement between the two L-shaped seats.

5. The input module as claimed in claim 3 further having an isolation plate sandwiched between the two resilient leg sets to separate the two resilient legs, the isolation plate provided with a clamping ring formed on opposite sides of the isolation plate to correspond to the securing ears of the respective L-shaped seat and a hole defined through the isolation plate to receive therein a grounding plate.

6. The input module as claimed in claim 5, wherein each L-shaped seat has a positioning rod and a positioning hole oppositely defined in one side of the seat so that extension of the positioning rods into corresponding positioning holes secures engagement between the two L-shaped seats.

7. The input module as claimed in claim 5, wherein the grounding plate has two oppositely extended extension plates to abut the two L-shaped seats.

8. The input module as claimed in claim 7, wherein each L-shaped seat has a positioning rod and a positioning hole oppositely defined in one side of the seat so that extension of the positioning rods into corresponding positioning holes secures engagement between the two L-shaped seats.

* * * * *